US010244867B2

(12) United States Patent
Liang et al.

(10) Patent No.: US 10,244,867 B2
(45) Date of Patent: Apr. 2, 2019

(54) SLIDE RAIL MECHANISM AND ADJUSTING ASSEMBLY FOR SLIDE RAIL

(71) Applicants: KING SLIDE WORKS CO., LTD., Kaohsiung (TW); KING SLIDE TECHNOLOGY CO., LTD., Kaohsiung (TW)

(72) Inventors: Hsiu-Chiang Liang, Kaohsiung (TW); Ken-Ching Chen, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 15/638,717

(22) Filed: Jun. 30, 2017

(65) Prior Publication Data

US 2018/0160805 A1 Jun. 14, 2018

(30) Foreign Application Priority Data

Dec. 12, 2016 (TW) ..... 105141292 A

(51) Int. Cl.
*A47B 88/40* (2017.01)
*A47B 88/427* (2017.01)
*A47B 88/407* (2017.01)

(52) U.S. Cl.
CPC ..... *A47B 88/427* (2017.01); *A47B 88/407* (2017.01); *A47B 2210/0054* (2013.01); *A47B 2210/0056* (2013.01)

(58) Field of Classification Search
CPC ... A47B 88/407; A47B 88/427; A47B 88/423; A47B 88/40
USPC ..... 312/334.4, 334.5, 334.1, 334.6
See application file for complete search history.

(56) References Cited

U.S. PATENT DOCUMENTS 5,375,922 A * 12/1994 Brustle ..... A47B 88/427 312/330.1
8,585,165 B2 * 11/2013 Liang ..... A47B 88/427 312/334.4
8,857,929 B2 * 10/2014 Netzer ..... A47B 88/0422 312/334.4
8,979,223 B2 * 3/2015 Huang ..... A47B 88/0422 312/334.4
8,991,952 B2 * 3/2015 Salice ..... A47B 88/0422 312/334.4
9,060,604 B2 * 6/2015 Salice ..... A47B 88/04
2001/0019235 A1 * 9/2001 Hammerle ..... A47B 88/407 312/334.4
2002/0158557 A1 * 10/2002 Weichelt ..... A47B 88/427 312/334.4
2004/0239219 A1 * 12/2004 Kim ..... A47B 88/427 312/334.4
2009/0167128 A1 * 7/2009 Berger ..... A47B 88/427 312/334.4

(Continued)

*Primary Examiner* — James O Hansen
(74) *Attorney, Agent, or Firm* — Rosenberg, Klein & Lee

(57) ABSTRACT

A slide rail mechanism includes a slide rail, a resilient member, and an adjusting device. The slide rail includes a front portion and a rear portion. The resilient member is located between the front portion and the rear portion of the slide rail and includes a first portion and a second portion, wherein the first portion is fixed with respect to the slide rail. The adjusting device is configured for adjusting the height of the second portion with respect to the first portion.

10 Claims, 11 Drawing Sheets

(56) References Cited

U.S. PATENT DOCUMENTS

| | | | | |
|---|---|---|---|---|
| 2009/0236959 | A1* | 9/2009 | Liang | A47B 88/427 312/334.4 |
| 2009/0251037 | A1* | 10/2009 | Berger | A47B 88/427 312/334.1 |
| 2012/0080988 | A1* | 4/2012 | Greussing | A47B 88/427 312/334.6 |

* cited by examiner

SLIDE RAIL MECHANISM AND ADJUSTING ASSEMBLY FOR SLIDE RAIL

FIELD OF THE INVENTION

The present invention relates to a slide rail and more particularly to a slide rail mechanism with an adjusting device.

BACKGROUND OF THE INVENTION

Generally, a slide rail assembly is used to enable a furniture part to be opened and closed with respect to another furniture part. With the advancement of slide rail technology, the market is now supplied with an undermount drawer slide, which is mounted on the bottom of a drawer and stays hidden from view (i.e., beneath the drawer) when the drawer is pulled out with respect to the body of a cabinet.

U.S. Pat. No. 8,231,189 B2, for example, discloses an undermount drawer slide that can prevent a drawer from sliding out of a cabinet by accident. This undermount drawer slide (10) includes a first rail (12) and a second rail (14) displaceable with respect to the first rail (12). The first rail (12) has a first installation section (22) and a second installation section (24), which are securely mounted at the rear and front ends of a sidewall of a cabinet (38) respectively. As the vertical distances from the first and second installation sections (22, 24) to a horizontal reference plane are different, the drawer slide (10) has a rearward inclination configuration, inclined at an angle R, once mounted to the cabinet (38). The top wall (28) of the second rail (14) of the undermount drawer slide has a protrusion (34) propping the bottom of a drawer (40) and adapted to compensate for the angle of inclination of a drawer panel (42), wherein the inclination may occur when the drawer panel (42) is mounted to the cabinet (38). Thus, the undermount drawer slide allows the verticality of the drawer panel (42) to be corrected to ensure that the drawer panel (42) is level with respect to the cabinet (38).

U.S. Pat. No. 8,870,313 B2 discloses a pull-out guide for a drawer, wherein the pull-out guide includes a first holding element (5) and a second holding element (15). The first holding element (5) and the second holding element (15) have a first height adjustment mechanism (6) and a second height adjustment mechanism (16) respectively. As shown in FIG. 3(a) and FIG. 3(b) accompanying the specification of the '313 B2 patent, the first height adjustment mechanism (6) includes a base support (10), which has two support brackets (20a, 20b). When a drawer (2) is connected to a connection element (7) of the first holding element, the drawer bottom (2b) partly rests on the two support brackets (20a, 20b). As a result of the connection to the drawer via the connection element (7), vertical movement of the base support (10) is transferred to the drawer (2).

According to FIG. 6 accompanying the specification of the '313 B2 patent, the two support brackets (20a, 20b) of the first height adjustment mechanism (6) are mounted respectively in the corresponding openings in a pull-out rail (3a) and thus occupy the bottom space of the pull-out rail (3a), making it impossible for other slide rail components to use this space freely.

As market demands and operational needs vary, it has been a common goal of the slide rail industry to develop an adjusting device for use with a slide rail to adjust the height or angle of inclination of the object carried by the slide rail.

SUMMARY OF THE INVENTION

The present invention relates to a slide rail and more particularly to a slide rail mechanism having an adjusting device.

According to one aspect of the present invention, a slide rail mechanism includes a slide rail, a resilient member, and a first adjusting device. The slide rail includes a front portion and a rear portion. The resilient member is located between the front portion and the rear portion of the slide rail and includes a first portion and a second portion, wherein the first portion is fixed with respect to the slide rail. The first adjusting device is configured for adjusting the height of the second portion with respect to the first portion.

Preferably, the first adjusting device includes a first base and a first adjusting member. The first base is configured for supporting the second portion of the resilient member. The first adjusting member is connected to the first base in an operable manner in order to adjust the height of the second portion of the resilient member with respect to the slide rail.

Preferably, the first adjusting member includes a main body portion and an eccentric portion. The main body portion and the eccentric portion have different axes, and the eccentric portion is mounted on the first base.

Preferably, the first adjusting member includes an operating portion connected to the main body portion.

Preferably, the first portion and the second portion of the resilient member are integrally formed, and the resilient member is arranged along the length of the slide rail.

Preferably, the resilient member is made of metal or plastic.

Preferably, the slide rail mechanism further includes a second adjusting device. The second adjusting device includes a second base and a second adjusting member for adjusting the transverse position of the second base.

Preferably, the second adjusting member is connected to the second base in an operable manner via a mount.

Preferably, the second base is pivotally connected to the mount.

Preferably, the slide rail mechanism further includes a first housing connected to the slide rail and a second housing mounted on the first housing, and the first adjusting device and the second adjusting device are mounted on the first housing and the second housing respectively.

Preferably, the first housing is connected to the slide rail at a position adjacent to the rear portion of the slide rail.

Preferably, the slide rail includes a projection, the first portion of the resilient member is connected to the projection, and the projection has a guiding feature. The guiding feature is an inclined or curved surface.

Preferably, the slide rail mechanism is adapted for a furniture part and further includes another slide rail longitudinally displaceable with respect to the aforesaid slide rail, wherein said another slide rail is configured for supporting the furniture part.

Preferably, the guiding feature is configured for guiding the furniture part when the furniture part is displaced from a mounting position in a mounting direction toward the rear portion of the aforesaid slide rail, in order for the furniture part to be mounted to the aforesaid slide rail.

Preferably, once the height of the second portion with respect to the first portion is adjusted by the first adjusting device, an angle of inclination of the furniture part is adjusted accordingly.

According to another aspect of the present invention, an adjusting assembly includes a first adjusting device. The first adjusting device includes a first base and a first adjusting member for operating the first base and thereby adjusting the height of the first base. The first adjusting member includes a main body portion and an eccentric portion, which have different axes. The eccentric portion is mounted on the first base.

Preferably, the adjusting assembly further includes a resilient member. The resilient member has a longitudinal length and includes a first portion and a second portion, wherein the second portion is connected to the first base.

Preferably, the adjusting assembly further includes a second adjusting device, a first housing, and a second housing. The second adjusting device includes a second base and a second adjusting member for adjusting the transverse position of the second base. The second housing is mounted on the first housing. The first adjusting device and the second adjusting device are mounted on the first housing and the second housing respectively.

DETAILED DESCRIPTION OF THE INVENTION

Figure 1:
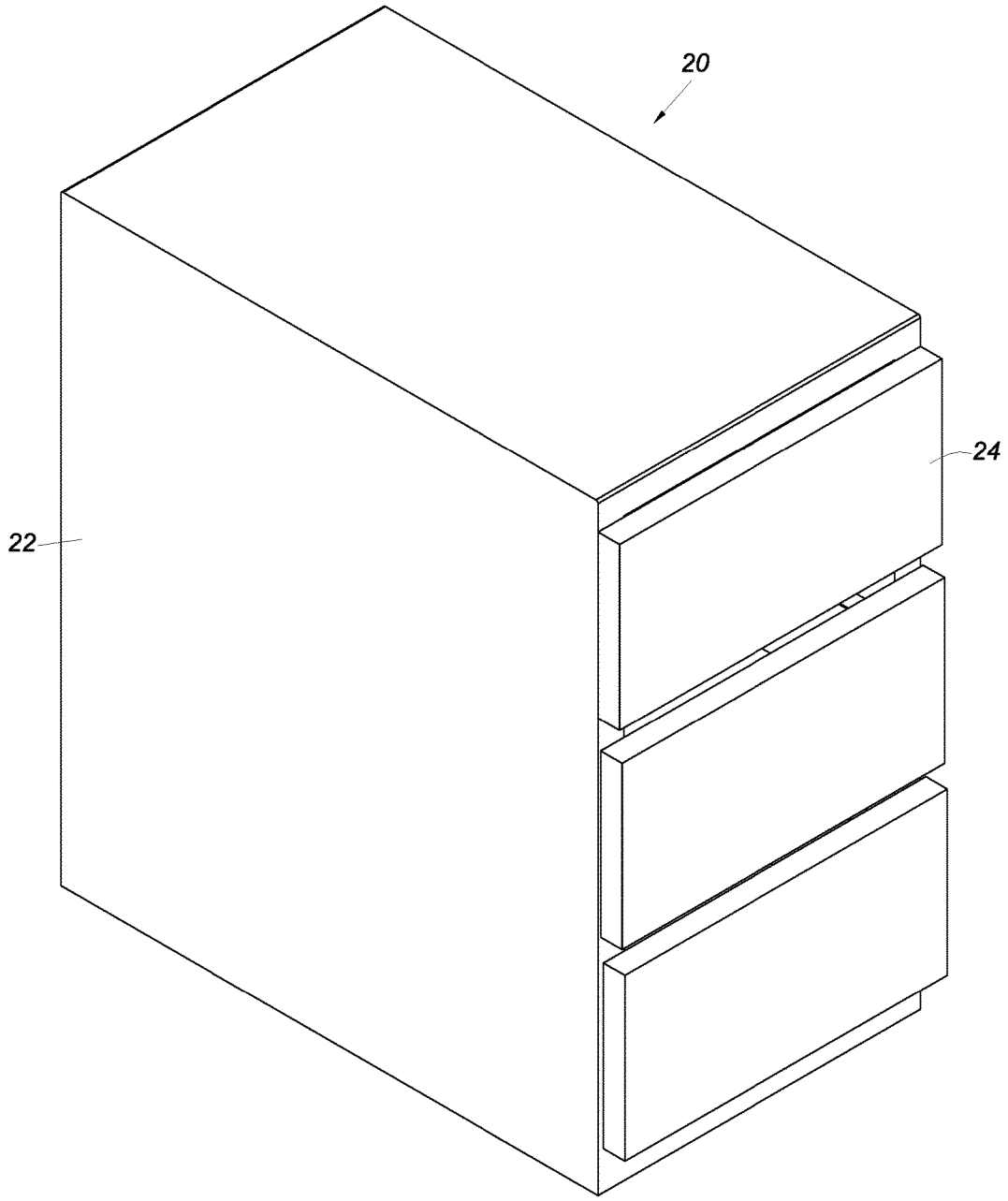
FIG. 1 is a perspective view of the furniture system in an embodiment of the present invention, wherein the furniture system includes a cabinet body and at least one drawer.

FIG. 1 shows a furniture system 20 that includes a first furniture part and a second furniture part. Here, the furniture parts are exemplified by a cabinet body 22 and at least one drawer 24 (which is referred to in the appended claims as a furniture part). The drawer 24 can be opened and closed with respect to the cabinet body 22.

Figures 2, 3, 4:
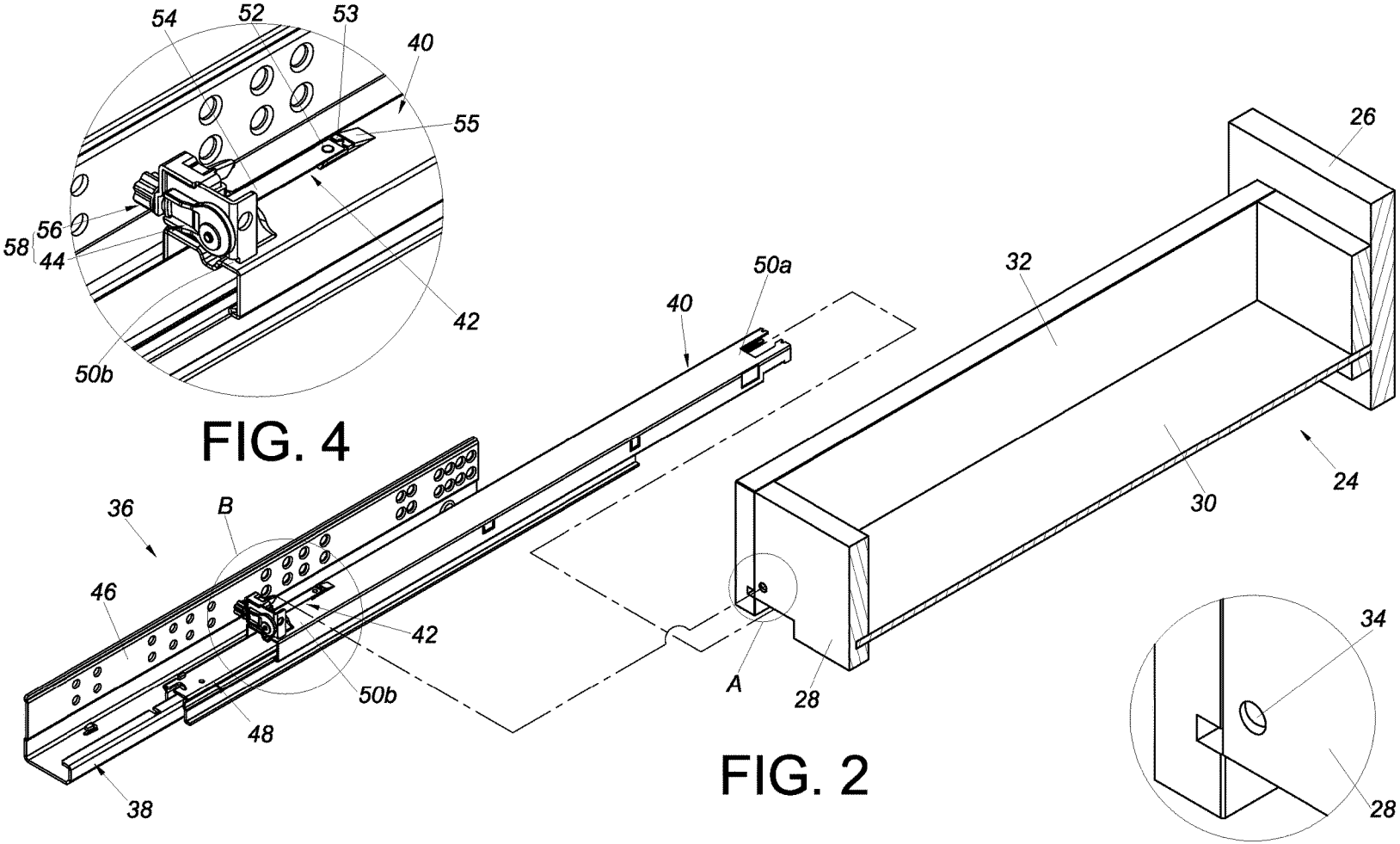
FIG. 2 is an exploded perspective view of a drawer and a corresponding slide rail mechanism in the furniture system according to an embodiment of the present invention.
FIG. 3 is an enlarged view of the area A in FIG. 2.
FIG. 4 is an enlarged view of the area B in FIG. 2.

Referring to FIG. 2, the drawer 24 (shown only partially in the drawing) includes a front wall 26 (e.g., a front panel), a rear wall 28, a bottom portion 30, and a sidewall 32. Referring also to FIG. 3, the rear wall 28 of the drawer 24 has a mounting feature such as a mounting hole 34. The slide rail mechanism 36 in this embodiment of the present invention is adapted for a furniture part such as the drawer 24. More specifically, the slide rail mechanism 36 includes a first rail 38, a second rail 40 (referred to in the appended claims as a slide rail), a resilient member 42, and a first adjusting device 44 (see FIG. 4).

The first rail 38 has a supporting rail section 46 configured to be fixed to a target object such as the cabinet body 22. The second rail 40 can be longitudinally displaced along the length of the first rail 38. Preferably, the slide rail mechanism 36 further includes a third rail 48 movably mounted between the first rail 38 and the second rail 40 to increase the distance for which the second rail 40 can be displaced with respect to the first rail 38.

Referring to FIG. 2 and FIG. 4, the resilient member 42 is located between a front portion 50*a* and a rear portion 50*b* of the second rail 40. In this embodiment, the resilient member 42 is provided adjacent to the rear portion 50*b* of the second rail 40. The resilient member 42 includes a first portion 52 and a second portion 54, wherein the first portion 52 is fixed with respect to the second rail 40. For instance, the first portion 52 is fixed to the second rail 40 by riveting, soldering, threaded connection, or other fixing means. Preferably, the resilient member 42 is arranged along the length of the second rail 40 and has a longitudinal length. Preferably, the first portion 52 and the second portion 54 of the resilient member 42 are integrally formed, and the resilient member 42 is made of metal or plastic. Preferably, the second rail 40 includes a projection 53, and the first portion 52 of the resilient member 42 is connected to the projection 53. The projection 53 has a guiding feature 55 such as an inclined or curved surface.

The first adjusting device 44 is configured to adjust the height of the second portion 54 of the resilient member 42 with respect to the first portion 52. Preferably, a second adjusting device 56 is also provided and is adjacent to the first adjusting device 44. The first adjusting device 44 and the second adjusting device 56 make up an adjusting assembly 58.

Figure 5:
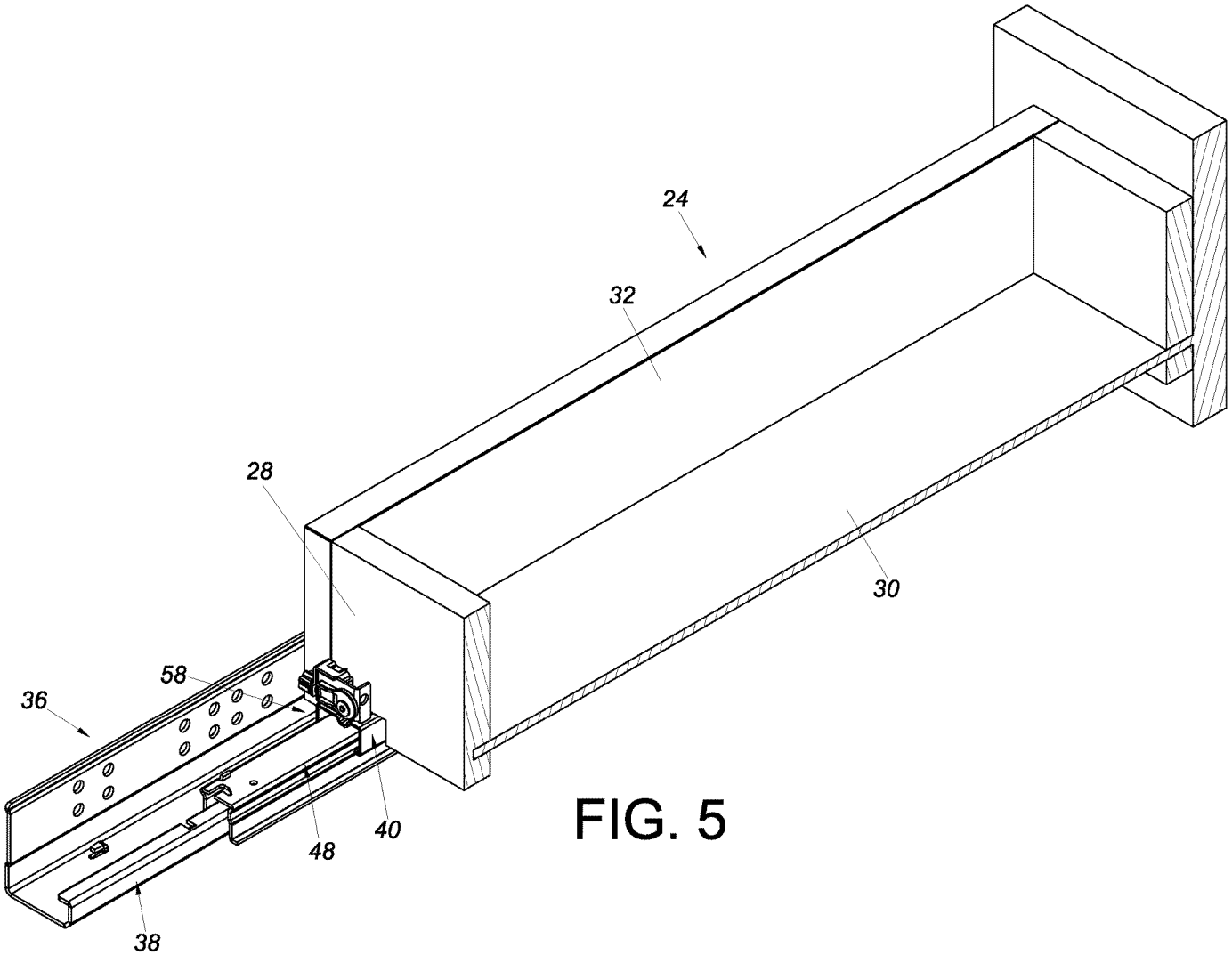
FIG. 5 is a perspective view showing how the drawer and the slide rail mechanism in an embodiment of the present invention are mounted with respect to each other.

FIG. 5 shows how the drawer 24 and the slide rail mechanism 36 are mounted with respect to each other. The bottom portion 30 of the drawer 24 is supported by the second rail 40. By displacing the second rail 40 with respect to the first rail 38, the drawer 24 can be displaced with respect to the cabinet body 22 from a retracted state to an opened state.

Figure 6:
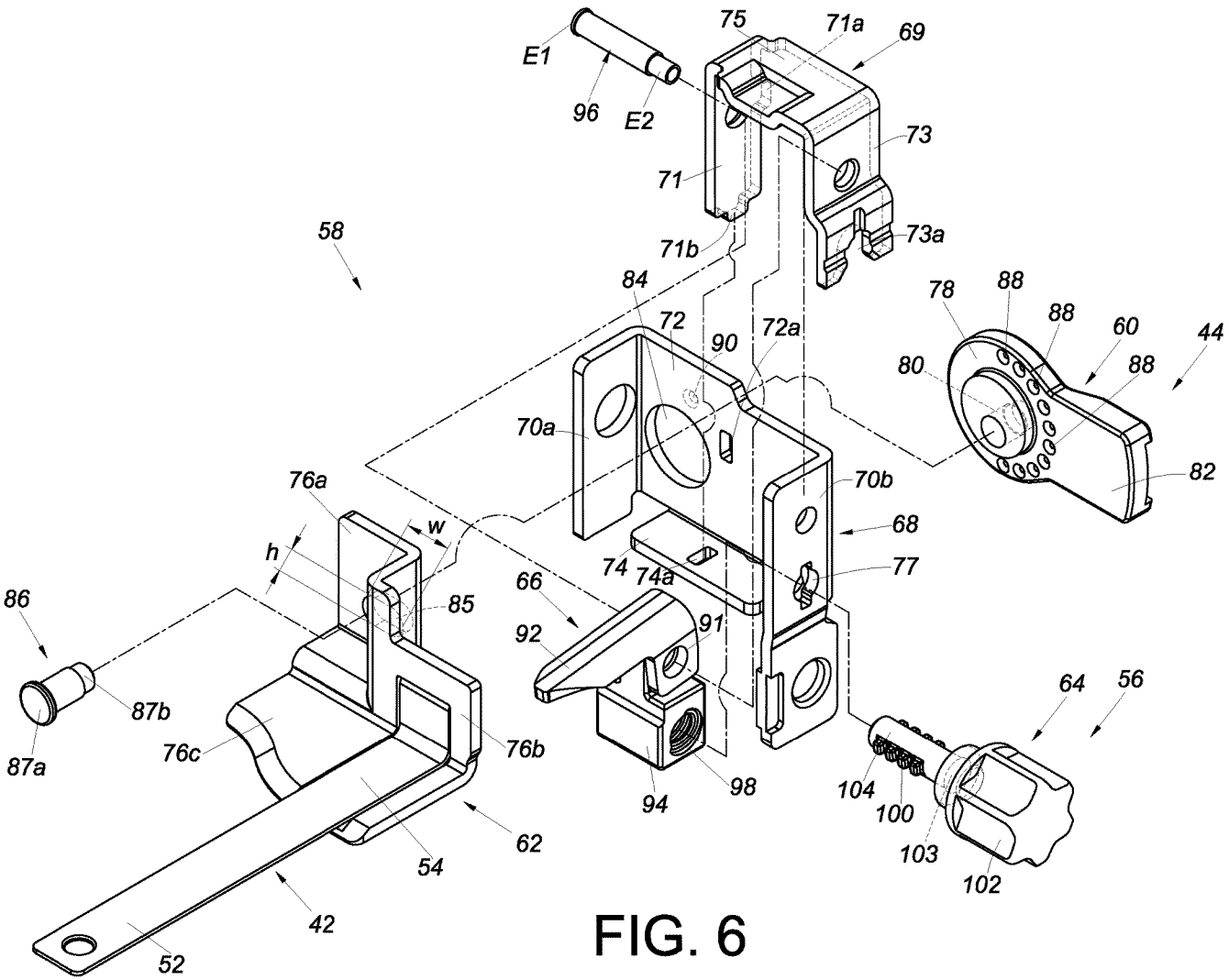
FIG. 6 is an exploded perspective view of the adjusting assembly of the slide rail mechanism according to an embodiment of the present invention.
Figure 7:
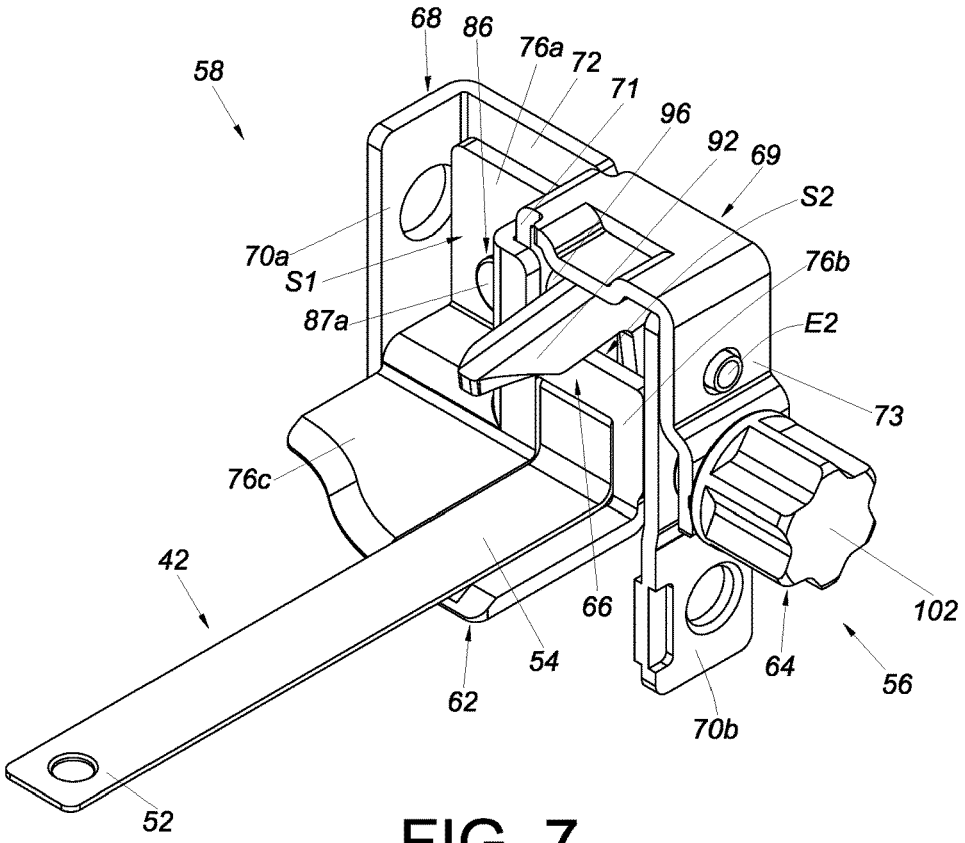
FIG. 7 is an assembled perspective view of the adjusting assembly in an embodiment of the present invention.

As shown in FIG. 6 and FIG. 7, the first adjusting device 44 includes a first adjusting member 60 and a first base 62. Similarly, the second adjusting device 56 includes a second adjusting member 64 and a second base 66.

Preferably, the first adjusting device 44 is mounted on a first housing 68, and the second adjusting device 56, on a second housing 69. More specifically, the first housing 68 includes a first side plate 70*a*, a second side plate 70*b*, a rear plate 72, and a bottom plate 74. The rear plate 72 extends between and connects the first side plate 70*a*, the second side plate 70*b*, and the bottom plate 74. In addition, the rear plate 72 has a first engaging feature 72*a*, and the bottom plate 74 has a second engaging feature 74*a*. The engaging features 72*a* and 74*a* are implemented in the form of holes. The second side plate 70*b* of the first housing 68 further has a side hole 77.

The second housing 69 includes a first partition plate 71, a second partition plate 73, and a top plate 75. The top plate 75 extends between and connects the first partition plate 71 and the second partition plate 73. The first partition plate 71 has two corresponding features 71*a* and 71*b* configured to engage with and be secured in position with respect to the first engaging feature 72*a* and the second engaging feature 74*a* of the first housing 68 respectively so that the second housing 69 is mounted firmly on the first housing 68. Once the second housing 69 is mounted on the first housing 68, the second partition plate 73 of the second housing 69 either lies against or is adjacent to the second side plate 70*b* of the first housing 68. When put together, therefore, the first housing 68 and the second housing 69 can be viewed as a single housing structure. According to the foregoing arrangement, the first partition plate 71 of the second housing 69 and the first housing 68 define a first mounting space 51 and a second mounting space S2. Besides, the second partition plate 73 has a notch 73*a* corresponding to the side hole 77 in the second side plate 70*b* of the first housing 68.

Preferably, the first base 62 of the first adjusting device 44 includes a first wall 76*a*, a second wall 76*b*, and a supporting wall 76*c* substantially perpendicularly connected to one of the first wall 76*a* and the second wall 76*b*. Here, the supporting wall 76*c* is connected to both the first wall 76*a* and the second wall 76*b* by way of example. The first wall 76*a* and the second wall 76*b* correspond in position to the first mounting space S1 and the second mounting space S2 respectively.

It is worth mentioning that the supporting wall 76*c* is configured to support the second portion 54 of the resilient member 42, wherein the second portion 54 of the resilient member 42 is away from the first portion 52. Preferably, the second portion 54 is connected to the first base 62 by mechanical engagement, riveting, soldering, threaded connection, or the like.

The first adjusting member 60 of the first adjusting device 44 includes a main body portion 78, an eccentric portion 80, and an operating portion 82. The main body portion 78 is substantially a circular structure. The eccentric portion 80 and the main body portion 78 have different axes (i.e., their centers of circle are not aligned with each other). The eccentric portion 80 can extend through an opening 84 in the rear plate 72 of the first housing 68 in order to be mounted to the first base 62, thus enabling adjustment, or displacement, of the first base 62 by the first adjusting member 60. Preferably, the first base 62 includes a connection hole 85 corresponding to the eccentric portion 80 of the first adjusting member 60, and the width w of the connection hole 85 is slightly greater than the diameter of the eccentric portion 80 of the first adjusting member 60. Here, the connection hole 85 is a slot by way of example. Preferably, a connecting member 86 is arranged at the first base 62 and has a first connecting portion 87*a* and a second connecting portion 87*b* connected to the first connecting portion 87*a*. The diameter of the first connecting portion 87*a* is greater than the height h of the connection hole 85 so that the first connecting portion 87*a* stays outside the connection hole 85 when mounted on the first base 62. The diameter of the second connecting portion 87*b* is, on the other hand, smaller than the height h of the connection hole 85, allowing the second connecting portion 87*b* to pass through the connection hole 85 and connect with the eccentric portion 80 of the first adjusting member 60. The operating member 82 is connected to the main body portion 78.

Preferably, one of the main body portion 78 of the first adjusting member 60 and the first housing 68 has a plurality of first features 88, and the other of the main body portion 78 of the first adjusting member 60 and the first housing 68 has a second feature 90 corresponding to the first features 88. Here, by way of example, the main body portion 78 is peripherally provided with the first features 88, and the rear plate 72 of the first housing 68 has the second feature 90. The first and second features 88 and 90 are matching structures such as a plurality of recesses and a projection, or a plurality of projections and a recess. When the first adjusting member 60 is adjusted, or displaced, the first features 88 will engage with the second feature 90 sequentially so that, once adjusted or displaced to the desired position, the first adjusting member 60 is temporarily secured in position with respect to the first housing 68.

It is worth mentioning that, in practice, the second feature 90 may be provided at the periphery of the main body portion 78 instead, with the first features 88 provided at the first housing 68; the present invention imposes no limitation in this regard.

The second base 66 of the second adjusting device 56 includes a supporting leg 91 and an extending section 92. The extending section 92 extends from the supporting leg 91 and has a predetermined longitudinal length. Preferably, the second adjusting member 64 is connected to the second base 66 in an operable manner via a mount 94, with the second base 66 pivotally connected to the mount 94. Here, the second base 66 is pivotally connected to the mount 94 by a shaft 96, and the two ends E1 and E2 of the shaft 96 extend through the first partition plate 71 and the second partition plate 73 of the second housing 69 respectively. Furthermore, the mount 94 has a first adjusting structure 98, and the second adjusting member 64 has a second adjusting structure 100 corresponding to the first adjusting structure 98. The first adjusting structure 98 and the second adjusting structure 100 may be threaded structures configured for threaded connection with each other.

Figure 8:
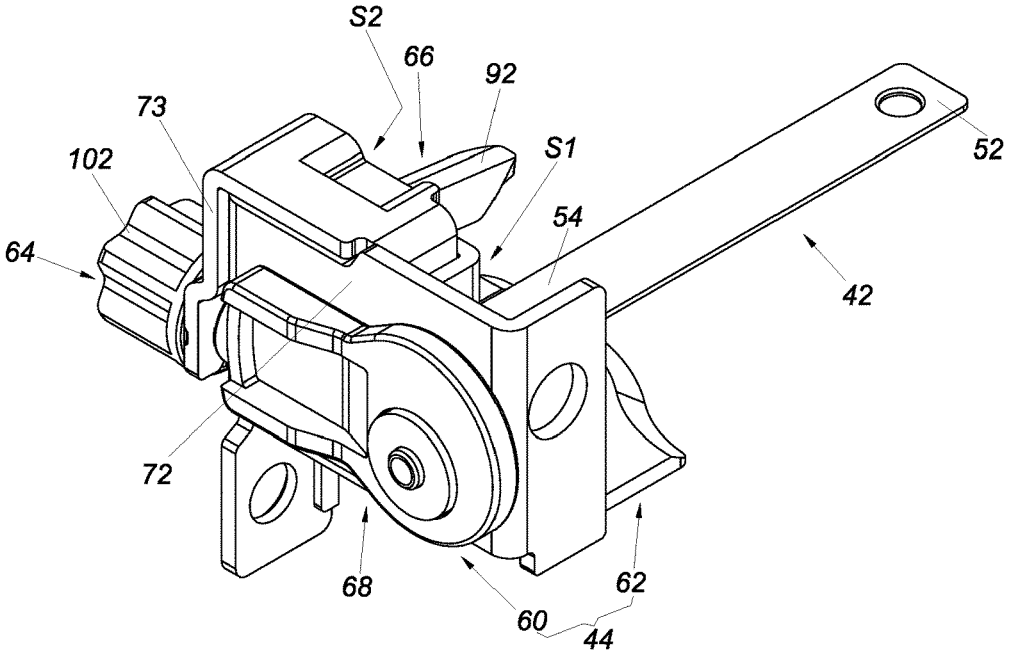
FIG. 8 shows the adjusting assembly in FIG. 7 from a different viewing angle.

Referring to FIG. 7 and FIG. 8, the first adjusting member 60 of the first adjusting device 44 is mounted on the rear plate 72 of the first housing 68. The second base 66 of the second adjusting device 56 is located in the second mounting space S2, with the extending section 92 of the second base 66 extending partially out of the second mounting space S2. The second adjusting member 64 of the second adjusting device 56 is mounted on the second partition plate 73 of the second housing 69. More specifically, as shown in FIG. 6 and FIG. 7, the second adjusting member 64 has a head 102, a neck 103 connected to the head 102, and a body 104 connected to the neck 103. The head 102 is larger in size than the neck 103 and the body 104. The body 104, which has the second adjusting structure 100, can pass through the notch 73*a* of the second housing 69 and enter the second mounting space S2 through the side hole 77 in the second side plate 70*b* of the first housing 68 in order to connect with the mount 94, with the head 102 staying outside the second partition plate 73 of the second housing 69, and the neck 103 corresponding to the wall of the notch 73*a* of the second partition plate 73 of the second housing 69 (see also FIG. 18 to FIG. 20).

Figure 9:
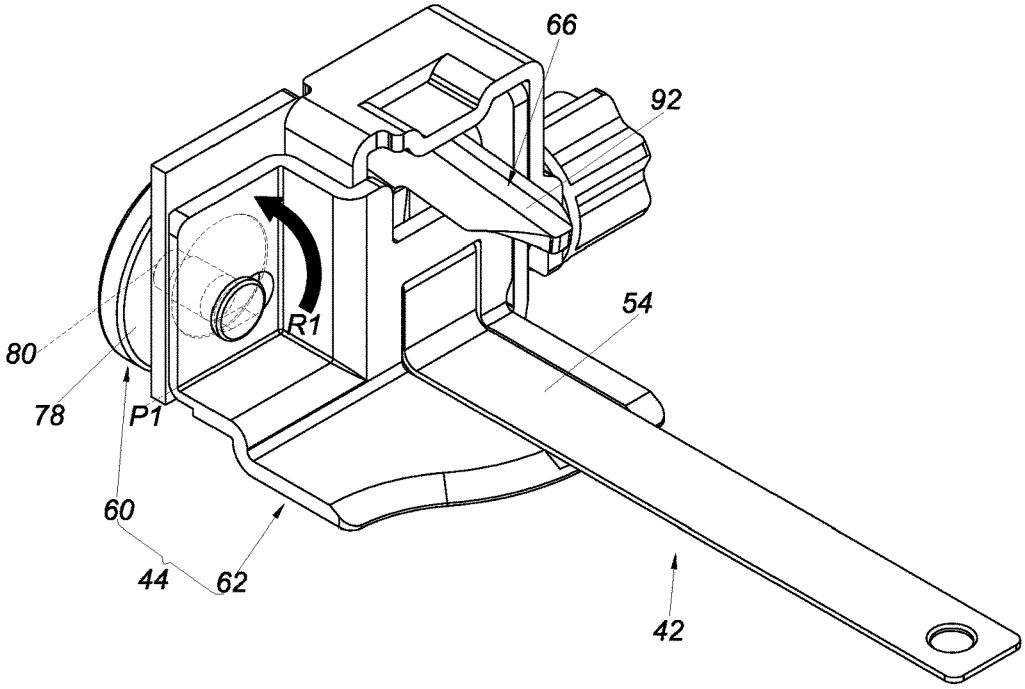
FIG. 9 is a perspective view showing the first adjusting device of the adjusting assembly according to an embodiment of the present invention, wherein the first adjusting device is in the initial state.
Figure 10:
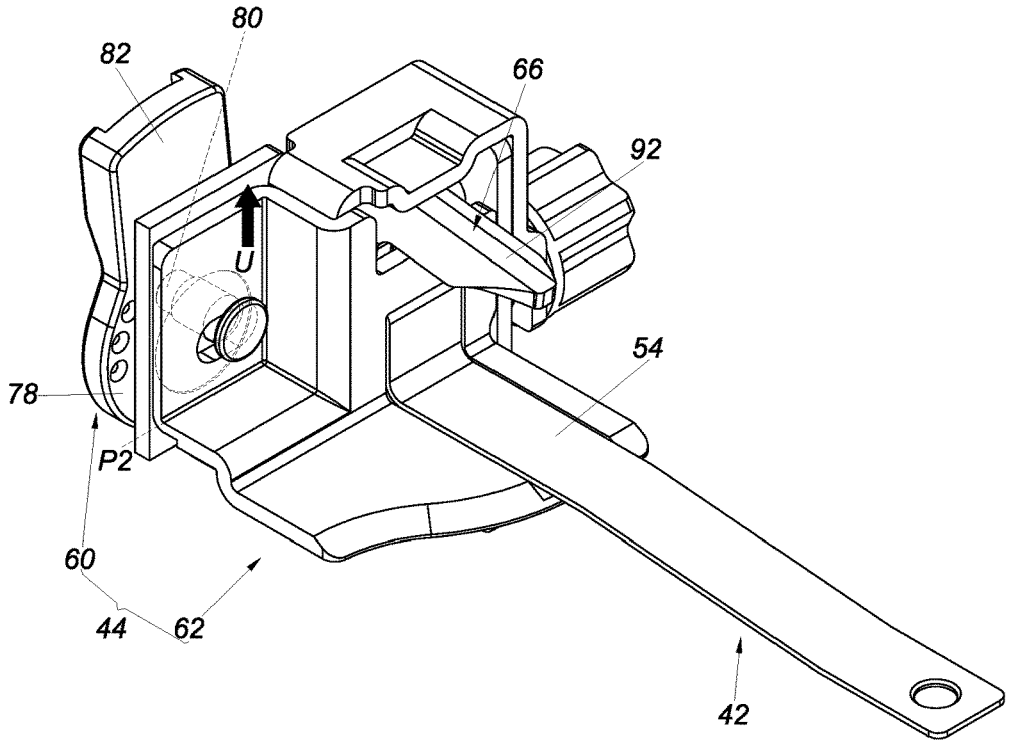
FIG. 10 is similar to FIG. 9 except that the first adjusting device is adjusted to a certain position.

Referring to FIG. 9 and FIG. 10, the first adjusting member 60 of the first adjusting device 44 is connected to the first base 62 in an operable manner, and the second portion 54 of the resilient member 42 is connected to the first base 62. As the eccentric portion 80 and the main body portion 78 of the first adjusting member 60 of the first adjusting device 44 have different axes, a force applied by the user to the operating portion 82 in a certain direction, e.g., a first rotating direction R1, will cause the eccentric portion 80 to lift the first base 62 from a first position P1 to a second position P2 in a vertical direction U. In other words, the first adjusting member 60 can operate the first base 62 and thereby adjust the height of the first base 62 and/or the resilient member 42.

Figure 11:
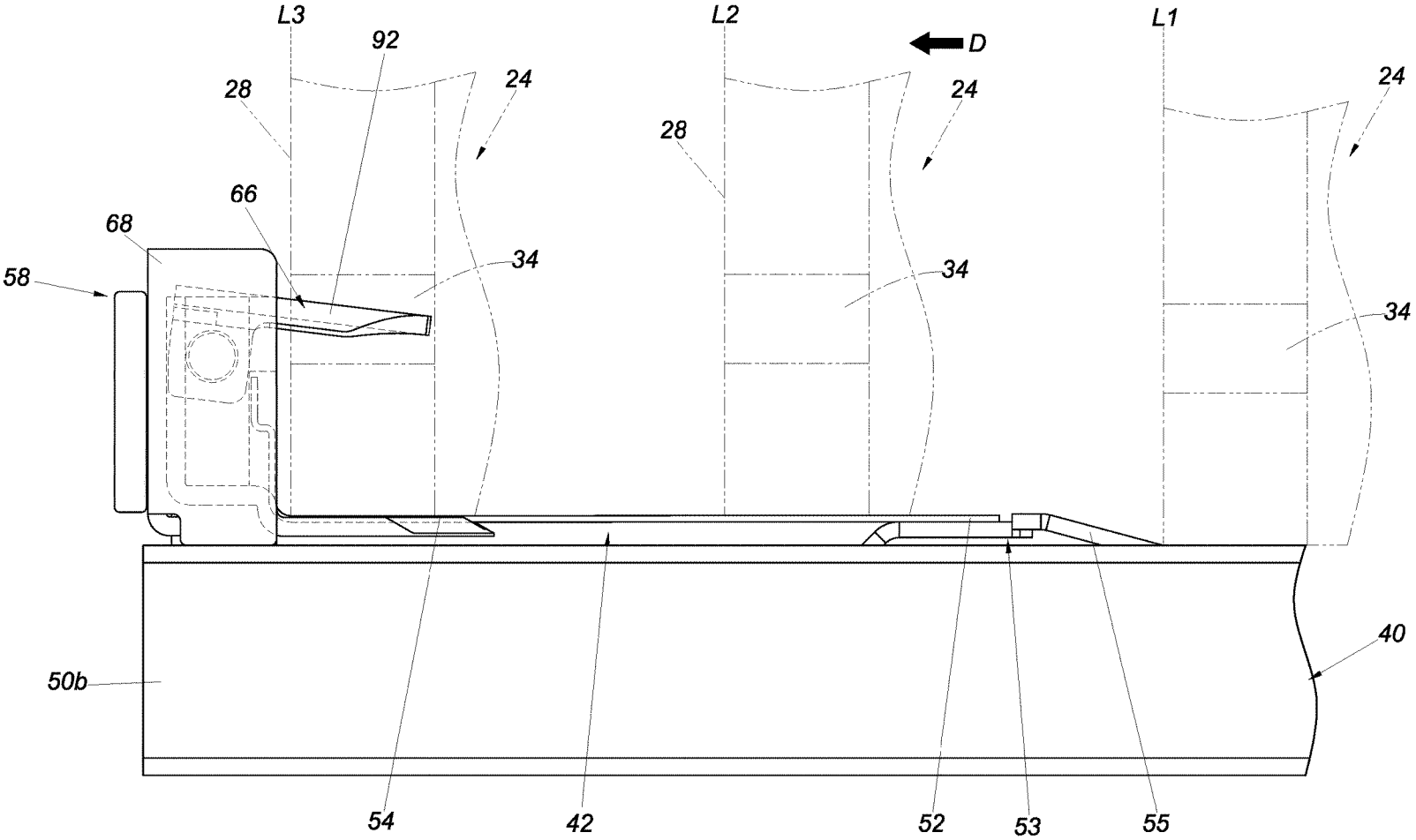
FIG. 11 shows how the drawer is mounted to a slide rail in a certain direction according to an embodiment of the present invention.

Referring to FIG. 11, the first housing 68 of the adjusting assembly 58 is connected to the second rail 40, e.g., fixedly connected to the second rail 40 at a position adjacent to the rear portion 50*b*. When it is desired to mount the drawer 24 to the second rail 40, the operator displaces the drawer 24 from a first mounting position L1 (referred to in the appended claims as a mounting position) toward the rear portion 50*b* of the second rail 40 in a mounting direction D. During the process, the drawer 24 climbs up to the resilient member 42 under the guidance of the guiding feature 55 of the projection 53. When the drawer 24 is further displaced from a second mounting position L2 corresponding to the first portion 52 of the resilient member 42 to a third mounting position L3 corresponding to the second portion 54, the extending section 92 of the second base 66 is inserted and thus mounted into the mounting hole 34 in the rear wall 28 of the drawer 24 such that the drawer 24 is mounted on the second rail 40.

Figure 12:
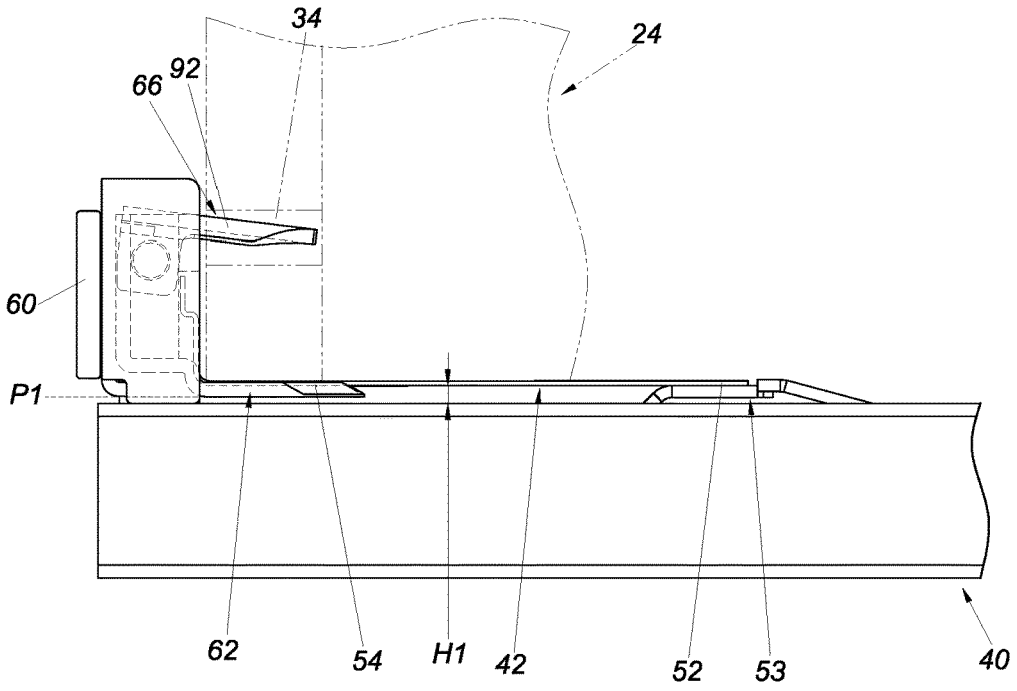
FIG. 12 shows the drawer in FIG. 11 mounted on the slide rail, wherein the second portion of the resilient member is supported at a first height by the first base of the first adjusting device.
Figure 13:
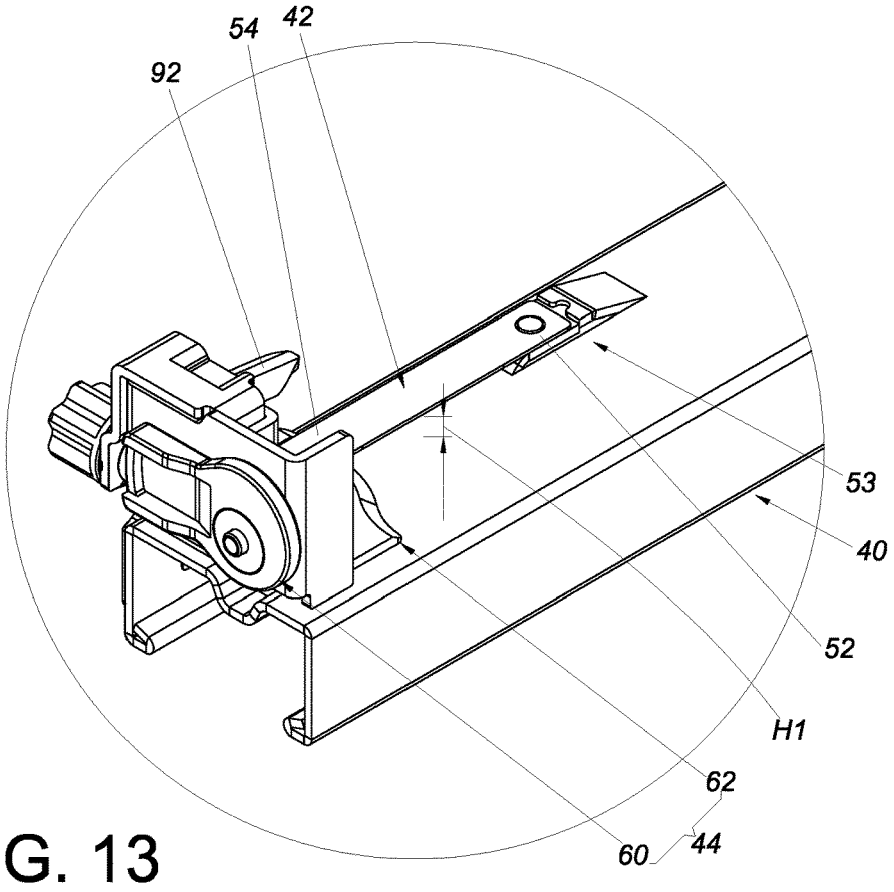
FIG. 13 is a perspective view showing how the second portion of the resilient member in FIG. 12 is supported at the first height by the first base of the first adjusting device.

FIG. 12 shows the drawer 24 mounted on the second rail 40. As shown in the drawing, the first portion 52 of the resilient member 42 is connected (e.g., fixedly connected) to the projection 53 of the second rail 40, and the first base 62 of the first adjusting device 44 is at the first position P1, supporting the second portion 54 of the resilient member 42. In this state, the second portion 54 of the resilient member 42 defines a height, e.g., a first height H1, with respect to the second rail 40. Referring also to FIG. 13, the first adjusting member 60 of the first adjusting device 44 is now in a predetermined state with respect to the first base 62.

Figure 14:
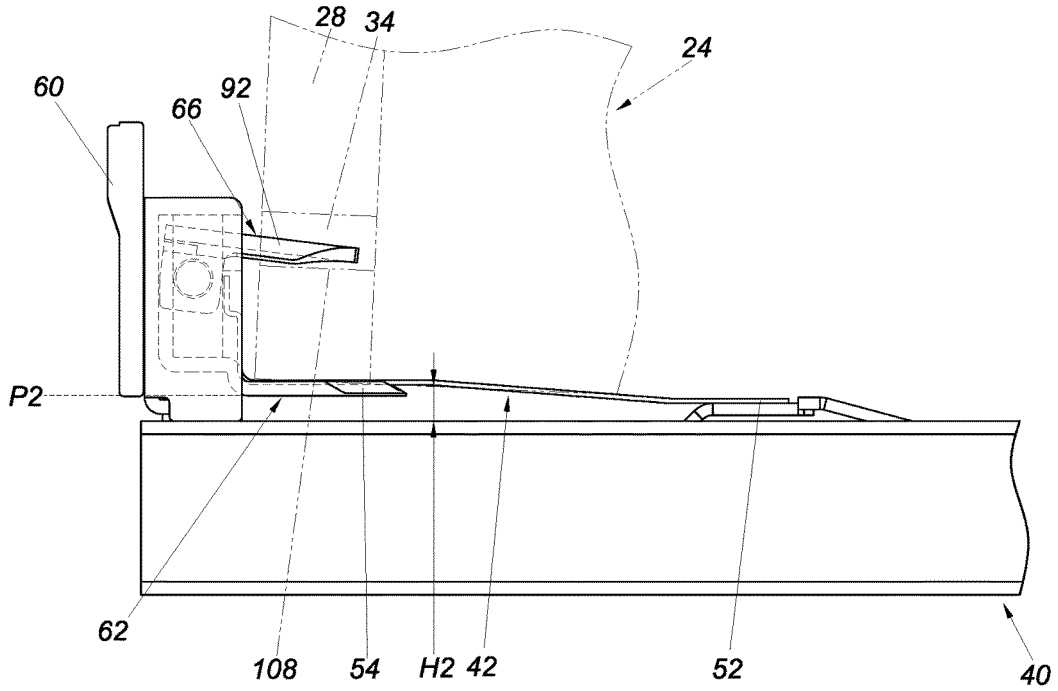
FIG. 14 is similar to FIG. 12 except that the second portion of the resilient member is supported at a second height by the first base of the first adjusting device.
Figure 15:
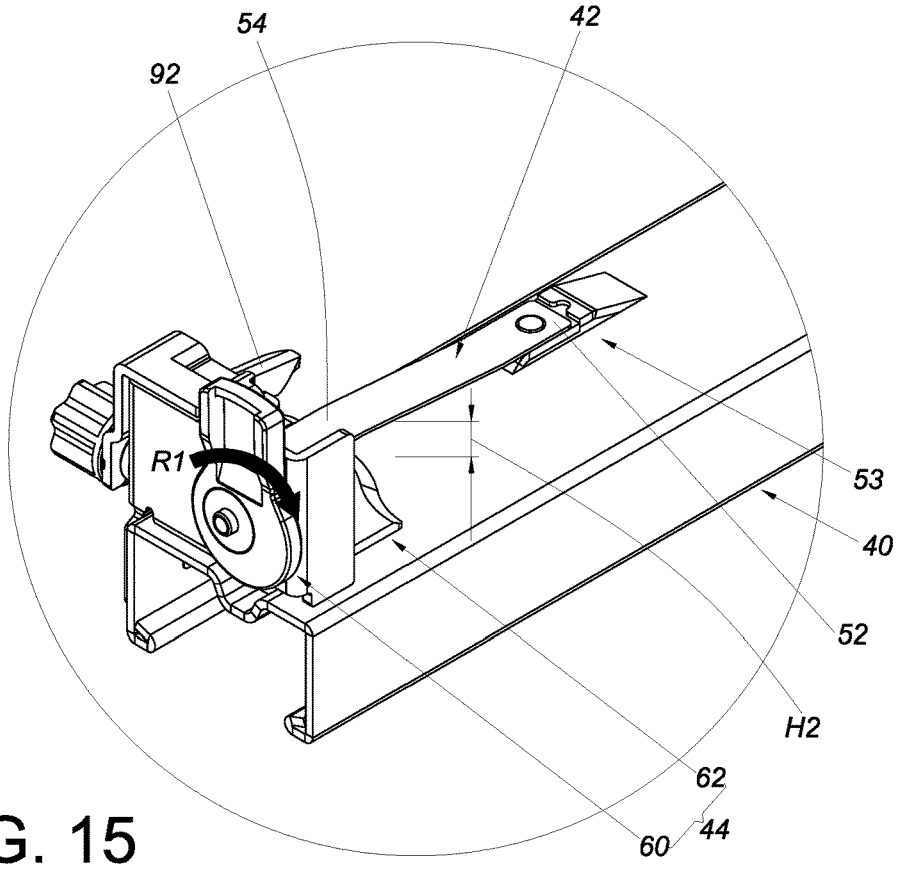
FIG. 15 is a perspective view showing how the second portion of the resilient member in FIG. 14 is supported at the second height by the first base of the first adjusting device.

When it is desired to adjust the angle of inclination of the drawer 24 with respect to the cabinet body 22, referring to FIG. 14 and FIG. 15, the operator may operate the first adjusting member 60 by applying thereto a force in the first rotating direction R1, with a view to lifting the first base 62 from the first position P1 to the second position P2, at which the second portion 54 of the resilient member 42 defines a second height H2 with respect to the second rail 40, wherein the second height H2 is greater than the first height H1, or H2>H1 in mathematical terms. That is to say, the rear wall 28 of the drawer 24 can be lifted with respect to the front wall 26, and in doing so, the wall 108 of the mounting hole 34 of the rear wall 28 will tilt the extending section 92 of the second base 66 upward through a small angle.

Figure 16:
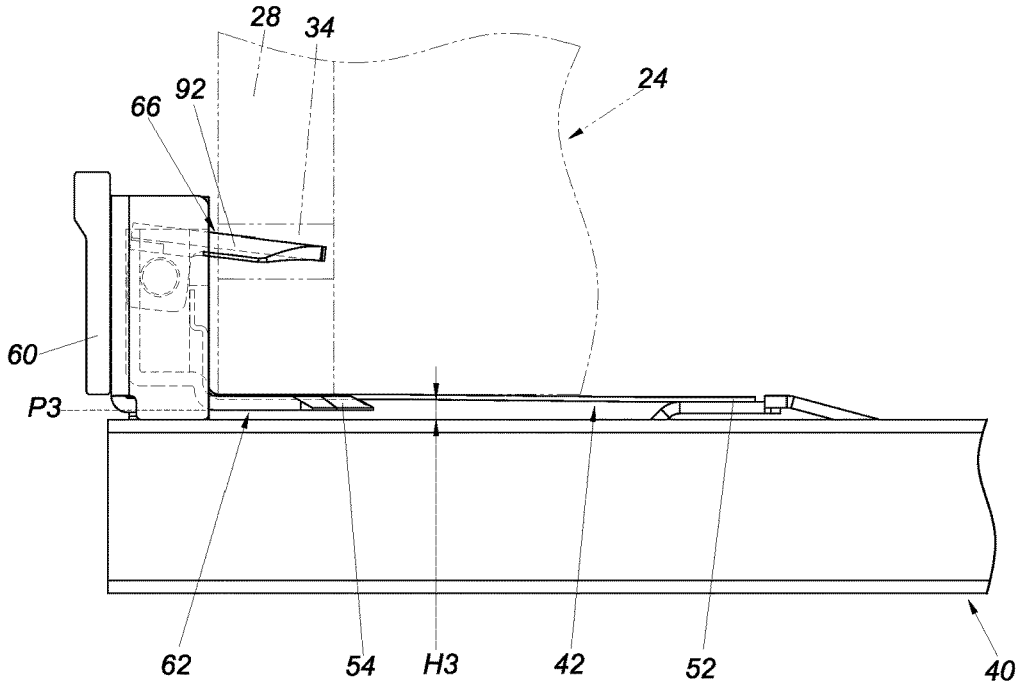
FIG. 16 is similar to FIG. 14 except that the second portion of the resilient member is now supported at a third height by the first base of the first adjusting device.
Figure 17:
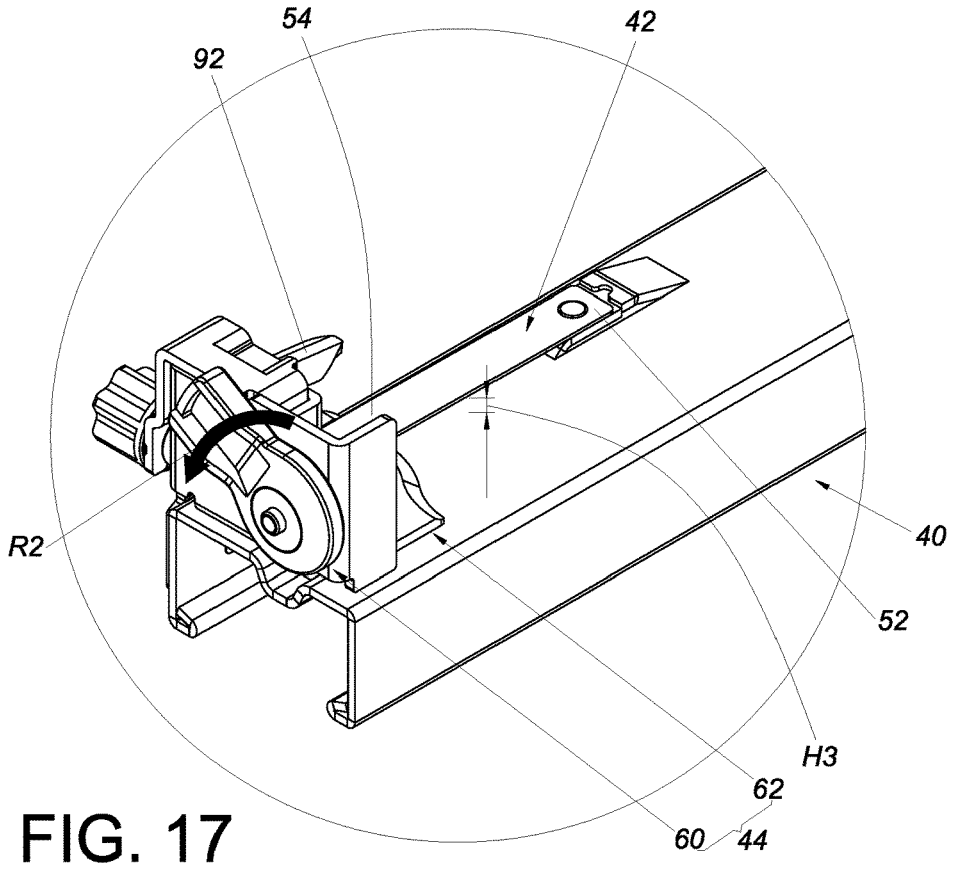
FIG. 17 is a perspective view showing how the second portion of the resilient member in FIG. 16 is supported at the third height by the first base of the first adjusting device.

Referring to FIG. 16 and FIG. 17, the operator may subsequently operate the first adjusting member 60 by applying thereto a force in a second rotating direction R2, in order to lower the first base 62 from the second position P2 to a third position P3, at which the second portion 54 of the resilient member 42 defines a third height H3 with respect to the first portion 52. The third height H3 is between the first height H1 and the second height H2, or H1<H3<H2 if expressed mathematically.

According to the above, the first portion 52 of the resilient member 42 is fixed with respect to the second rail 40 so that the first adjusting member 60 can be used to adjust the height of the second portion 54 with respect to the first portion 52, thereby changing the angle of inclination of the drawer 24. More specifically, the angle of inclination of the rear wall 28 of the drawer 24 with respect to the front wall 26 can be adjusted through the first adjusting device 44.

Figure 18:
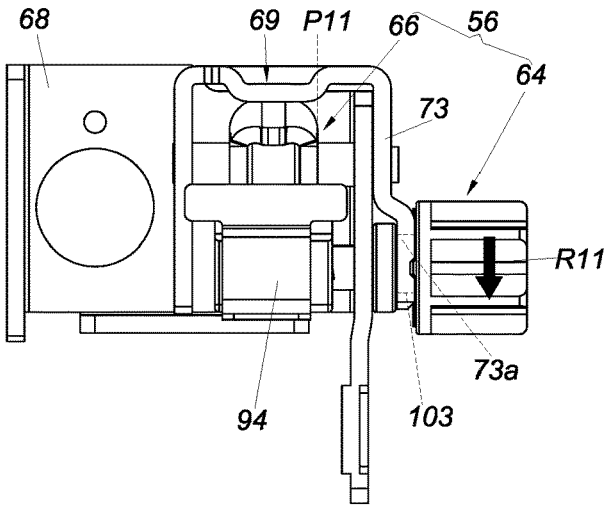
FIG. 18 shows how the second adjusting member of the second adjusting device in an embodiment of the present invention is operated in an adjusting direction in order to adjust the second base.
Figure 19:
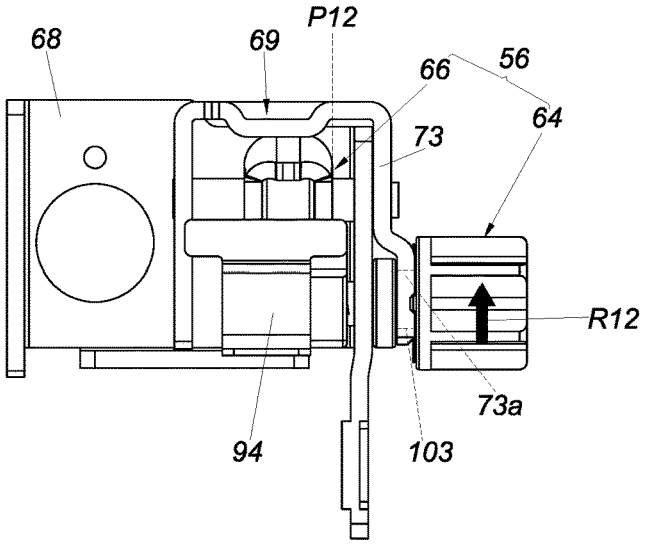
FIG. 19 shows that the second base of the second adjusting device in FIG. 18 is adjusted by the second adjusting member and hence displaced in a lateral direction.

Referring to FIG. 18 and FIG. 19, if the transverse position of the mounting hole 34 in the rear wall 28 of the drawer 24 does not match that of the second base 66 of the second adjusting device 56, the operator can adjust the transverse position of the second base 66 with respect to the longitudinal direction of the second rail 40 by means of the second adjusting member 64 of the second adjusting device 56. More specifically, the operator may apply to the second adjusting member 64 a force in a first adjusting direction R11 in order to displace the second base 66 laterally with respect to the first housing 68 from a first adjustment position P11 to a second adjustment position P12. Here, the mount 94 drives the second base 66 into lateral displacement in response to the operator's operation of the second adjusting member 64.

Figure 20:
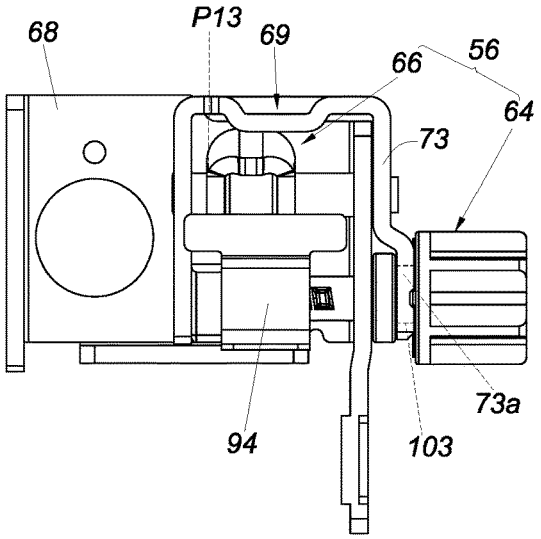
FIG. 20 shows that the second base of the second adjusting device in FIG. 19 is displaced in the opposite lateral direction as a result of further adjustment by the second adjusting member.

Referring to FIG. 19 and FIG. 20, the operator may subsequently apply to the second adjusting member 64 a force in a second adjusting direction R12 so that the second base 66 is laterally displaced with respect to the first housing 68 from the second adjustment position P12 to a third adjustment position P13.

While the present invention has been disclosed through the preferred embodiments described above, it should be understood that the foregoing embodiments are not intended to be restrictive of the scope of the invention. The scope of patent protection sought by the applicant is defined by the appended claims.

What is claimed is:

1. A slide rail mechanism, comprising:

a slide rail having a front portion and a rear portion;

a resilient member located between the front portion and the rear portion of the slide rail, wherein the resilient member includes a first portion and a second portion, and the first portion is fixed with respect to the slide rail;

a first adjusting device for adjusting a height of the second portion of the resilient member with respect to the first portion thereof, the first adjusting device including a first base and a first adjusting member connected to the first base in an operable manner, the first base being configured for supporting the second portion of the resilient member, and the first adjusting member being configured for adjusting the height of the second portion of the resilient member with respect to the slide rail;

a second adjusting device, the second adjusting device including a second base and a second adjusting member for adjusting a transverse position of the second base; and a first housing connected to the slide rail and a second housing mounted on the first housing, the first adjusting device and the second adjusting device being respectively mounted on the first housing and the second housing.

2. The slide rail mechanism of claim 1, wherein the first adjusting member includes a main body portion and an eccentric portion, the main body portion and the eccentric portion have different axes, and the eccentric portion is mounted on the first base.

3. The slide rail mechanism of claim 1, wherein the first portion and the second portion of the resilient member are integrally formed, and the resilient member is arranged along a length of the slide rail.

4. The slide rail mechanism of claim 1, wherein the resilient member is made of metal or plastic.

5. The slide rail mechanism of claim 1, wherein the second adjusting member is connected to the second base in an operable manner via a mount.

6. The slide rail mechanism of claim 5, wherein the second base is pivotally connected to the mount.

7. The slide rail mechanism of claim 1, wherein the first housing is connected to the slide rail at a position adjacent to the rear portion of the slide rail.

8. The slide rail mechanism of claim 1, wherein the slide rail includes a projection, the first portion of the resilient member is connected to the projection, and the projection has a guiding feature selected from the group consisting of an inclined surface and a curved surface.

9. A slide rail mechanism adapted for a furniture part, the slide rail mechanism comprising:

a first rail;

a second rail longitudinally displaceable with respect to the first rail, wherein the second rail is configured for supporting the furniture part;

a resilient member located between opposing front and rear portions of the second rail and including a first portion and a second portion, wherein the first portion is fixed with respect to the second rail;

a first adjusting device for adjusting a height of the second portion of the resilient member with respect to the first portion thereof and thereby adjusting an angle of inclination of the furniture part, the first adjusting device including a first base for supporting the second portion of the resilient member and a first adjusting member connected to the first base in an operable manner in order to adjust the height of the second portion of the resilient member, the first adjusting member including a main body portion and an eccentric portion, the main body portion and the eccentric portion having different axes, the eccentric portion being mounted on the first base, and the first adjusting member including an operating portion connected to the main body portion;

a second adjusting device, the second adjusting device including a second base and a second adjusting member for adjusting a transverse position of the second base, the second base being configured to be mounted to a hole in a rear wall of the furniture part, and the second adjusting member being connected to the second base in an operable manner via a mount; and a first housing connected to the second rail and a second housing mounted on the first housing, the first adjusting device and the second adjusting device being respectively mounted on the first housing and the second housing.

10. The slide rail mechanism of claim 9, wherein the second rail includes a projection, the first portion of the resilient member is connected to the projection, the projection has a guiding feature selected from the group consisting of an inclined surface and a curved surface, and the guiding feature is configured for guiding the furniture part when the furniture part is displaced from a mounting position in a mounting direction toward a rear portion of the second rail, in order for the furniture part to be mounted to the second rail.

* * * * *